United States Patent [19]

Ejiri et al.

[11] Patent Number: 4,735,179

[45] Date of Patent: Apr. 5, 1988

[54] AUTOMATIC CONTROL APPARATUS FOR ENGINE THROTTLE VALVE

[75] Inventors: Yuki Ejiri; Tomoo Ito, both of Katsuta, Japan

[73] Assignee: Hitachi, Ltd., Tokyo, Japan

[21] Appl. No.: 913,243

[22] Filed: Sep. 30, 1986

[30] Foreign Application Priority Data

Oct. 4, 1985 [JP] Japan ..... 60-220109

[51] Int. Cl.[4] ..... F02D 9/02; F02D 17/04

[52] U.S. Cl. ..... 123/332; 123/401; 123/198 D

[58] Field of Search ..... 123/360, 361, 359, 376, 123/396, 401, 327, 328, 332, 198 D, DIG. 11

[56] References Cited

U.S. PATENT DOCUMENTS 4,098,850 7/1978 Tamura ..... 261/65
4,196,704 4/1980 Cook ..... 123/DIG. 11
4,601,271 7/1986. Ejiri et al. ..... 123/361

*Primary Examiner*—William A. Cuchlinski, Jr.
*Attorney, Agent, or Firm*—Antonelli, Terry & Wands

[57] ABSTRACT

A throttle valve is supported rotatably on a pipeline. The throttle valve is driven by a motor. A downstream side of the throttle valve is connected to an engine. A means for opening the throttle valve forcedly is provided so as not to allow a tar component in the fuel for driving the engine to stick on the throttle valve at an outer peripheral portion when the engine is shut down.

4 Claims, 3 Drawing Sheets

AUTOMATIC CONTROL APPARATUS FOR ENGINE THROTTLE VALVE

BACKGROUND OF THE INVENTION

1. Field of the Invention

The present invention relates to a control of automobile internal combustion engines, and is particularly concerned with an automatic control apparatus for an engine throttle valve which is capable of minimizing loads of a motor for controlling a position of the throttle valve.

2. Description of the Prior Art

As a control apparatus for internal combustion engine throttle valves, there known hitherto, for example, are "Control Apparatus for Internal Combustion Engine Throttle Valves" disclosed in Japanese Patent Publication No. 25853/1983 dated May 30, 1983 and "Valve Driving Device" disclosed in Japanese Patent Laid-Open No. 145867/1980 dated Nov. 13, 1980.

In such conventional apparatuses, a throttle valve is supported rotatably on a pipeline. A motor for driving the throttle valve is coupled direct to the throttle valve or connected thereto through a reduction gear. A return spring is provided on the throttle valve, and thus when a current is not carried to the motor, it is returned invariably to a position whereat an engine comes to idling. A position sensor for detecting an opening is provided on the throttle valve, and information on a current position of the throttle valve is obtained from the position sensor, thereby applying a correction to a position control of the motor.

Generally in an automobile internal combustion engine for which a fuel injection is carried out downstream of the throttle valve, viscous deposits stick on the throttle valve due to a fuel scum return, a backfire and the like, which are capable of clogging the throttle valve at a full-open position. In the conventional apparatuses, a torque of the return spring is loaded in addition to a torque for relieving the throttle valve from such a clogged state, and thus a heavy torque is required for the motor. To obtain a heavy torque, a reduction ratio will be increased normally; however, such a measure is defective to deteriorate an answerability. To provide an enlarged motor therefor is to increase the weight of the apparatus inevitably, which is, needless to say, inadvisable.

SUMMARY OF THE INVENTION

An object of the invention is to provide an automatic control apparatus for an engine throttle valve operating on a small-sized motor wherein the throttle valve is prevented from being clogged at a full-open position without deteriorating an answerability.

The throttle valve is so clogged by deposits being hardened from leaving the throttle valve close for a long time after the engine is shut down. The valve will not be clogged if it is kept open as far as a certain position after shutdown of the engine, accordingly.

In the invention, an improvement is therefore such that an actuator operating at the time of engine shutdown is provided on the throttle valve, thus forcing the throttle valve to open as predetermined according to an operation of the actuator when the engine is shut down.

DETAILED DESCRIPTION OF THE PREFERRED EMBODIMENTS

Figure 1:
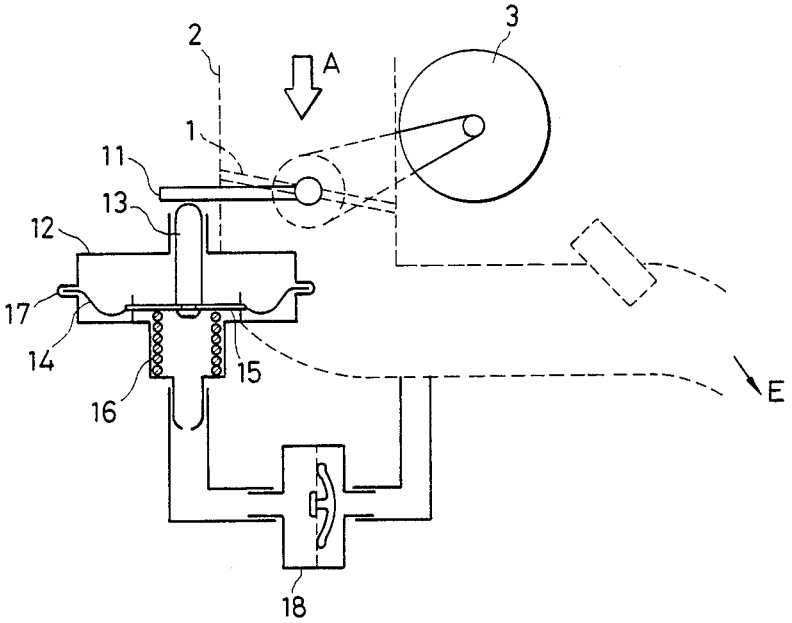
FIG. 1 represents one embodiment of the invention.

Referring now to FIG. 1, a throttle valve 1 is supported rotatably on a pipeline, and a lever 11 is fixed on one end thereof. An actuator 12 pushes the lever 11 to open the throttle valve. The actuator 12 comprises a diaphragm 14 and a retainer 15 for holding the diaphragm 14, a shaft 13 fixed on the retainer 15, and a case 17 for supporting the shaft slidably, the case 17 holding down the diaphragm 14 to form an airtight chamber on the side counter to the shaft 13.

There is provided a spring 16 for extruding the shaft on the airtight chamber side. The airtight chamber is connected to a check valve 18. The check valve 18 grows to a large orifice when stepping down on air pressure of the airtight chamber, but to a small orifice when stepping up the air pressure to the contrary, thus checking the air pressure from rising sharply. The check valve 18 communicates with the downstream of the throttle valve 1. A in FIG. 1 indicates the direction in which air flows, and E indicates the engine side. When the engine starts, a suction negative pressure is present and passes the check value 18, an air pressure of the airtight chamber of the actuator 12 drops, the diaphragm 14 is pulled, the spring 16 is compressed, the shaft 13 is also drawn in, and thus the throttle valve is closed.

The size of the spring 16 and that of the diaphragm 13 are so set as for them to operate even at the time of cranking.

When the engine stops, the suction negative pressure downstream of the throttle valve 1 is turned to an atmospheric pressure to step up the air pressure of the actuator 12; however, the air pressure does not rise quickly owing to the check valve 18 present therefor, the shaft 13 will not come out so suddenly, and thus the throttle valve is not opened right off after the engine stops. The check valve thus provided is effective enough to suppress a hunting.

Figure 2:
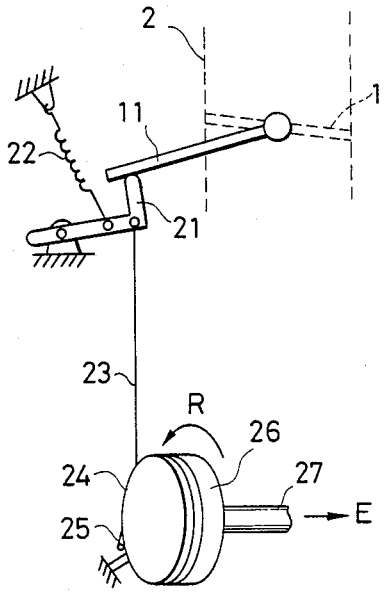
FIG. 2 represents another embodiment of the invention.
Figure 3:
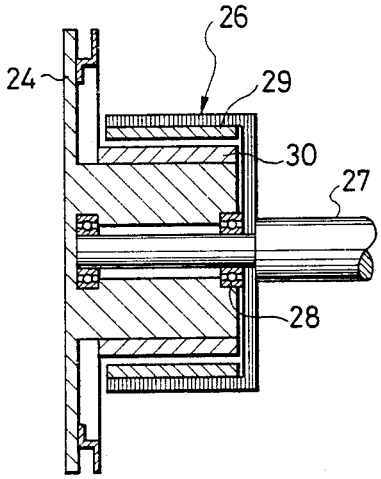
FIG. 3 is a drawing for illustrating in detail a magnetic coupling of FIG. 2.

FIG. 2 represents another embodiment. The throttle valve 1, a pipeline 2 and the lever 11 are disposed likewise as in the case of FIG. 1. A lever 21 is so disposed as to come in contact with the lever 11, and thus the throttle valve can be opened on a tensile force of a spring 22. A wire 23 is mounted on the lever 21, and thus when the wire 23 is pulled, the lever 21 is detached from the lever 11. The wire 23 is wound on a drum 24. The drum 24 has a stopper 25, which prevents the lever 21 from being overdrawn. The drum 24 is connected to an engine shaft 27 through a magnetic coupling 26. A structure of the magnetic coupling 26 is shown in FIG. 3. The drum 24 is rotatable with respect to the engine shaft 27 through a bearing 28. A magnet 30 is fixed on the drum 24. The magnetic coupling 26 is fixed on the engine shaft 27, and an iron plate 29 is fixed further thereon. A magnetic flux from the magnet 30 comes in the iron plate 29, and a torque is generated so as to rotate the drum in the same direction as that of engine rotation. The torque is generated in the direction R of FIG. 2, and the wire 23 is pulled thereby. The lever 21 is thus detached from the lever 11, and no action compes to exert on the throttle valve.

When the engine stops, the torque is not generated, a tensile force of the wire 23 is removed, and the lever 21 pushes the lever 11 by a force of the spring 22 to open the throttle valve.

Figure 4:
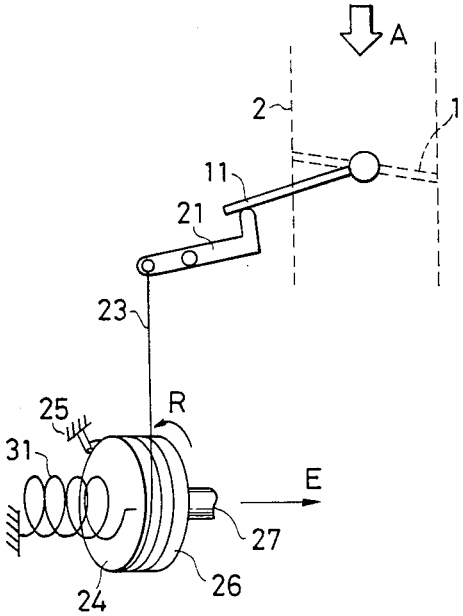
FIG. 4 is a drawing representing a further embodiment of the invention.

In FIG. 4, the same construction is given as in the case of FIG. 2; however, the spring is not provided direct on the lever 21, and a spring 31 is provided on the drum 24 of FIG. 2. Quite different from that of FIG. 2, the lever 21 extrudes the lever 11 when the wire 23 is pulled. The drum 24 generates a torque during rotation of the engine, moves in the direction losing a tensile force of the wire against the spring 31 and then stops on the stopper 25. The wire has the tensile force removed as above, therefore the lever 21 does not work on the lever 11. When the engine stops, the drum 24 loses the torque, and thus the drum 24 pulls the wire 23 on a torque of the spring 31. The lever 21 works on the lever 11 to open the throttle valve.

In the example of FIG. 4, when the wire 23 is cut, no action can be exerted on the throttle valve, and hence a car or engine can be prevented from running away.

Figure 5:
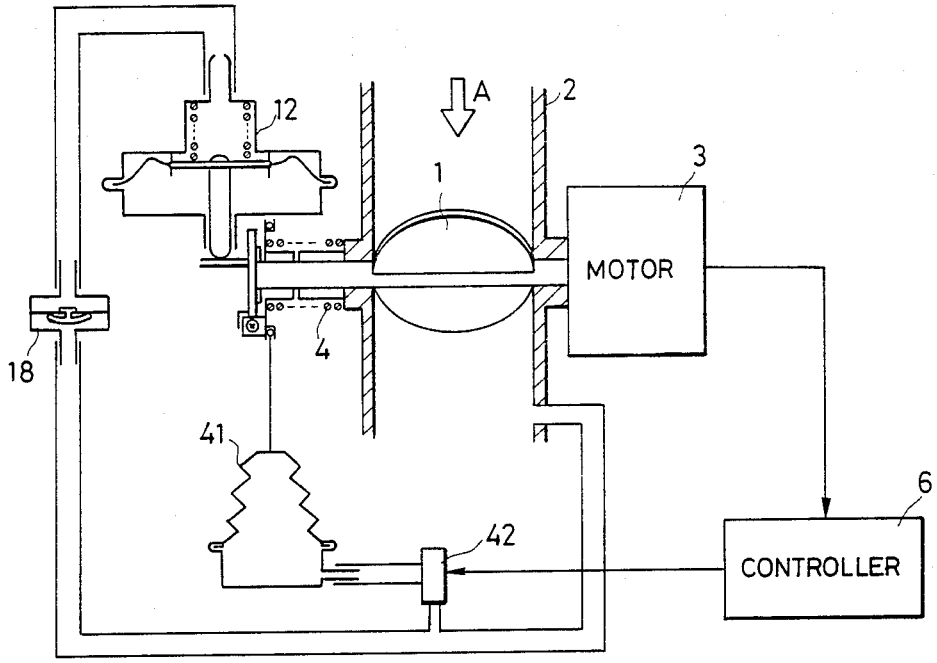
FIG. 5 is a drawing representing an even further embodiment of the invention.

In FIG. 5, a return spring 4 and an actuator 41 for keeping the return spring 4 from operating at the time of motor actuation are provided against the construction of FIG. 1. As in the case of the actuator 12, the actuator 41 operates on a suction negative pressure. A three-way solenoid valve 42 is provided halfway of the line connecting the actuator 41 and a suction pipe, a suction negative pressure is introduced to the actuator 41 when a solenoid is turned on, and an atmospheric pressure is introduced to the actuator 41 when the three-way solenoid valve 42 is turned off. The three-way solenoid valve 42 is turned on whenever the engine starts. However, when something is wrong with the motor to bring about an uncontrollable state, it is turned off upon decision of a controller 6, the atmosphere pressure is introduced to the actuator 41, the return spring 4 works on the throttle valve, and thus the throttle valve is closed as far as a position of idling frequency.

Figure 6:
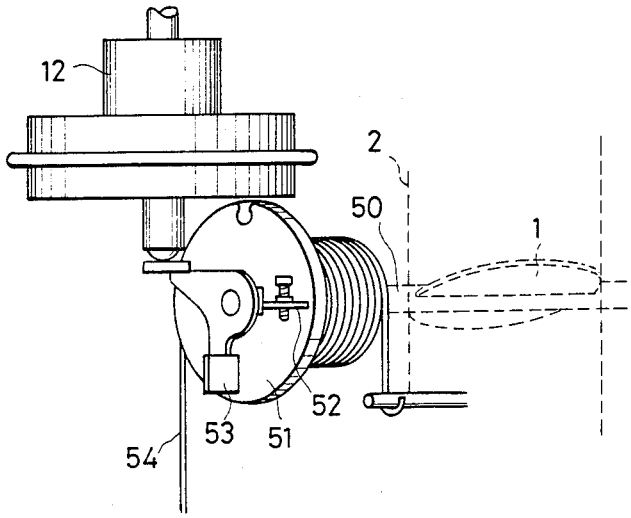
FIG. 6 is a drawing for illustrating in detail a lever of FIG. 5.

The return spring 4 of FIG. 5 and its periphery are shown in detail in FIG. 6. A drum 51 is rotatable with respect to a throttle valve shaft 50. An adjusting screw 52 is provided on the drum 51, which comes in contact with a lever 53 fixed on the throttle valve shaft 50, and thus the throttle valve 1 is closed by a torque of the return spring 4 mounted on the drum 51. A wire 54 is mounted on the drum 51, and when it is pulled, the adjusting screw 52 is detached from the lever 53, and the torque of the return spring will not work on the throttle valve. The actuator 12 operates on the lever 53 likewise as in the case of FIG. 1. According to the embodiment, a load of the motor is limited to a frictional force and a torque generated on the throttle valve according to an air stream.

As described above, according to the invention, since the throttle valve is never clogged at an idling position, it is not necessary to take an escape torque into consideration as a load of the motor for position control of the throttle valve, the load can be decreased accordingly, thus a gear with a large reduction ratio is unnecessary, and further the motor can be miniaturized reasonably.

What we claim is:

1. An automatic control apparatus for an engine throttle valve, consisting of a throttle valve and a motor for driving the throttle valve, the improvement comprising means for opening said throttle valve forcedly from a full-close position at the time of engine shutdown so as not to allow a tar component in the fuel for driving the engine to stick on said throttle valve at an outer peripheral portion, wherein the situation on whether or not said engine is shut down is detected according to rotations of an engine output shaft, thereby driving said means for opening the valve forcedly.

2. An automatic control apparatus for an engine throttle valve as defined in claim 1, wherein an actuating force of said means for opening the valve forcedly is obtained through a spring.

3. An automatic control apparatus for an engine throttle valve, consisting of a throttle valve and a motor for driving the throttle valve, the improvement comprising means for opening said throttle valve forcedly from a full-close position at the time of engine shutdown so as not to allow a tar component in the fuel for driving the engine to stick on said throttle valve at an outer peripheral portion, a return mechanism for returning said throttle valve to an idling position, a controller for detecting trouble in the operation of said motor, and a throttle valve reset mechanism for keeping said return mechanism from operating normally but sending an output for returning said return mechanism to the idling position according to a command from said controller when trouble condition of said motor is detected by said controller.

4. An automatic control apparatus for an engine throttle valve as defined in claim 3, wherein the situation on whether or not said engine is shut down in detected according to a presence of suction negative pressure of said engine, thereby driving said means for opening the valve forcedly.

* * * * *